US005771952A

United States Patent [19]

Gabriel

[11] Patent Number: 5,771,952

[45] Date of Patent: Jun. 30, 1998

[54] APPARATUS FOR ADJUSTING A WINDOW COVER SITUATED BETWEEN A WINDOW AND ASSOCIATED TRANSPARENT INSULATION

[76] Inventor: John D. Gabriel, 39056 E. Archer, Harrisom Twp, Mich. 48045

[21] Appl. No.: 746,168

[22] Filed: Nov. 7, 1996

[51] Int. Cl.[6] ..... A47H 1/00

[52] U.S. Cl. ..... 160/98; 160/107; 160/178.1; 160/265

[58] Field of Search ..... 160/107, 98, 265, 160/178.1 R, 177 R

[56] References Cited

U.S. PATENT DOCUMENTS

| | | | |
|---|---|---|---|
| 620,293 | 2/1899 | Fleming | 160/98 |
| 1,807,161 | 5/1931 | Loven | 160/265 X |
| 1,964,205 | 6/1934 | Johnson | 160/265 X |
| 2,847,064 | 8/1958 | Roth | 160/98 X |
| 4,553,580 | 11/1985 | Christoffersson | 160/107 X |
| 4,687,040 | 8/1987 | Ball | 160/107 |
| 5,497,820 | 3/1996 | Drake | 16/107 |

*Primary Examiner*—David M. Purol

[57] ABSTRACT

An apparatus for adjusting a window cover including a window surrounded by a frame. Further provided is a window cover adapted to have a first orientation wherein the window cover shrouds the window and a second orientation wherein the window cover does not shroud the window. The window covering has a conventional elongated control mechanism with a first end connected to the window covering and a second end for allowing a user to transfer the window covering from the first orientation to the second orientation thereof and visa-versa. Finally, a control mechanism redirecting mechanism is included for allowing the second end of the control mechanism to be utilized distant the window while maintaining a portion of the control mechanism adjacent the first end thereof stationary.

4 Claims, 3 Drawing Sheets

FIG 3
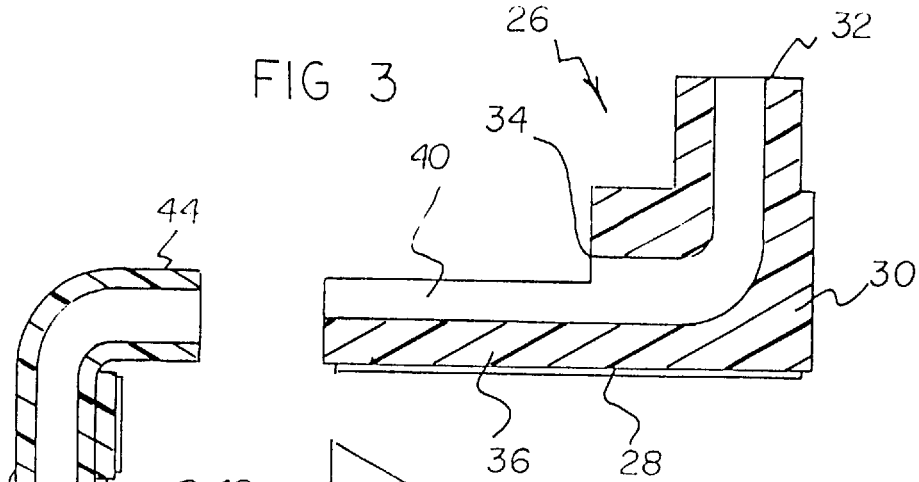
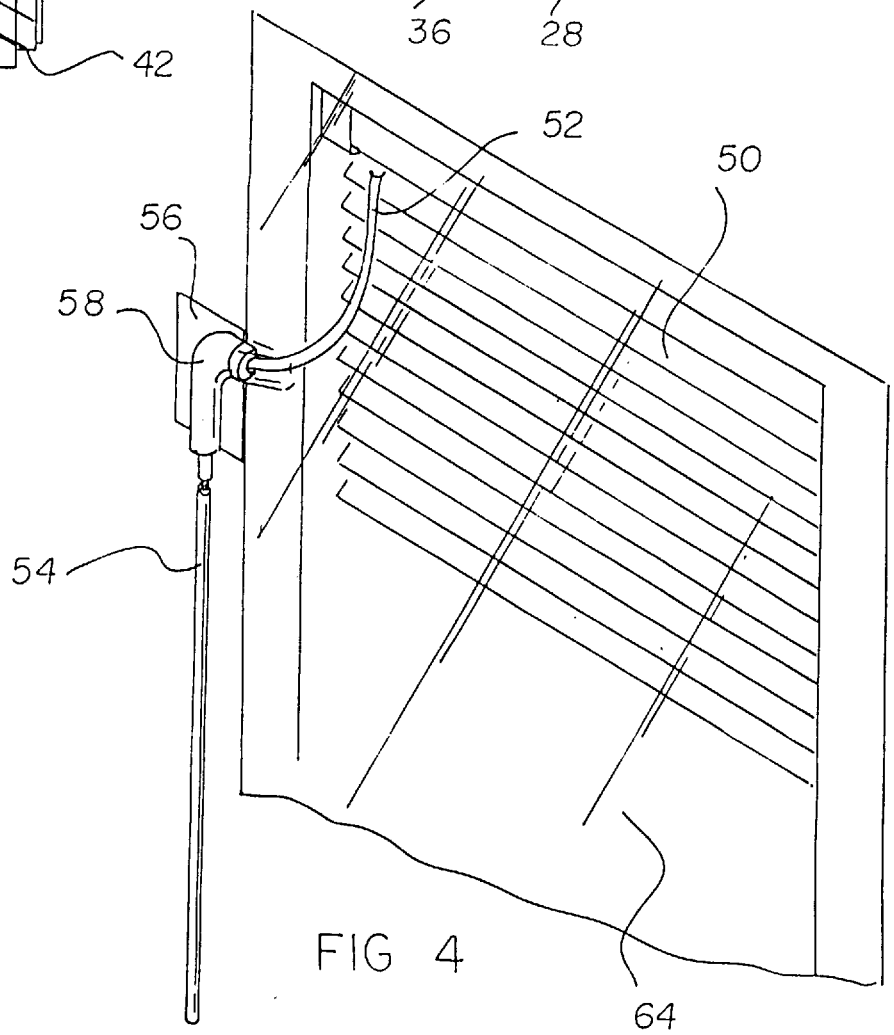
FIG 4

FIG 5
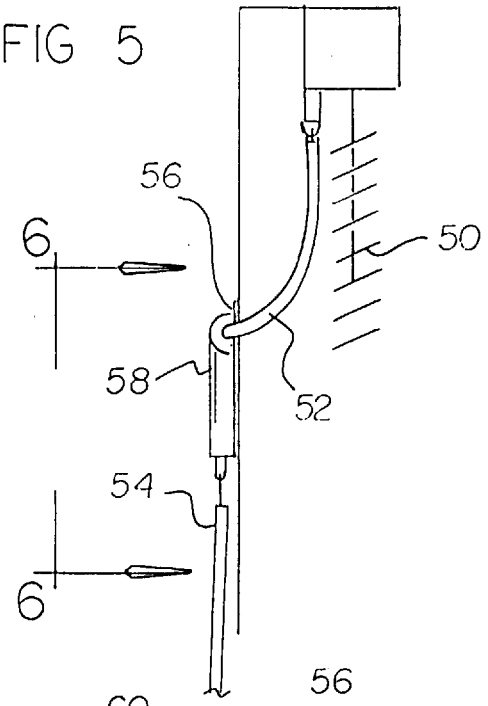
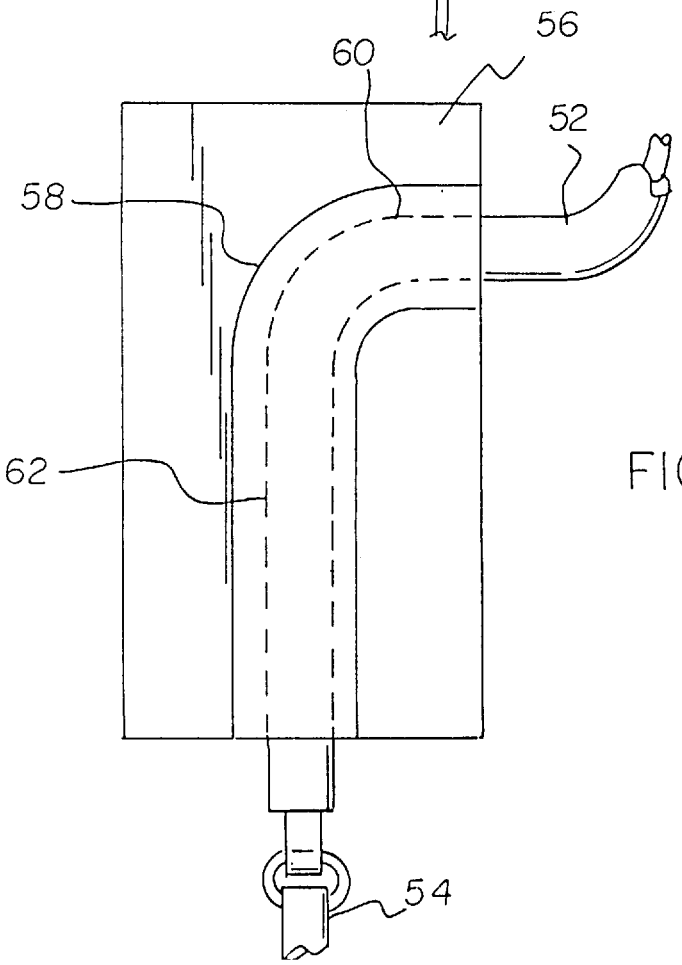
FIG 6

APPARATUS FOR ADJUSTING A WINDOW COVER SITUATED BETWEEN A WINDOW AND ASSOCIATED TRANSPARENT INSULATION

BACKGROUND OF THE INVENTION

1. Field of the Invention

The present invention relates to an apparatus for adjusting a window cover and more particularly pertains to selectively allowing light to enter through a window with a conventional window covering situated between the window and a transparent insulation film.

2. Description of the Prior Art

The use of window coverings is known in the prior art. More specifically, window coverings heretofore devised and utilized for the purpose of selectively allowing light to enter through a window are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 3,366,159 to Arnold; 4,274,469 to Kuyper et al.; U.S. Pat. No. 4,459,778 to Ball; and U.S. Pat. No. 4,687,040 to Ball.

In this respect, the apparatus for adjusting a window cover according to the present invention substantially departs from the conventional concepts and designs of the prior art, and in so doing provides an apparatus primarily developed for the purpose of selectively allowing light to enter through a window with a conventional window covering situated between the window and a transparent insulation film.

Therefore, it can be appreciated that there exists a continuing need for a new and improved apparatus for adjusting a window cover which can be used for selectively allowing light to enter through a window with a conventional window covering situated between the window and a transparent insulation film. In this regard, the present invention substantially fulfills this need.

SUMMARY OF THE INVENTION

In view of the foregoing disadvantages inherent in the known types of window covers now present in the prior art, the present invention provides an improved apparatus for adjusting a window cover. As such, the general purpose of the present invention, which will be described subsequently in greater detail, is to provide a new and improved apparatus for adjusting a window cover which has all the advantages of the prior art and none of the disadvantages.

To attain this, the present invention essentially comprises an apparatus for adjusting a window cover including a window surrounded by a frame. Further provided is a window cover adapted to have a first orientation wherein the window cover shrouds the window and a second orientation wherein the window cover does not shroud the window. The window covering has a conventional elongated control mechanism with a first end connected to the window covering and a second end for allowing a user to transfer the window covering from the first orientation to the second orientation thereof and visa-versa. Finally, a transfer mechanism redirecting means is included for allowing the second end of the control mechanism to be utilized distant the window while maintaining a portion of the control mechanism adjacent the first end thereof stationary. As such, the control mechanism extends away from the window sill allowing an additional transparent insulation means to be utilized in conjunction with maintaining operation of the window covering, wherein the window covering is situated between the window sill and the transparent insulation means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for adjusting a window cover which has all the advantages of the prior art window coverings and none of the disadvantages.

It is another object of the present invention to provide a new and improved apparatus for adjusting a window cover which may be easily and efficiently manufactured and marketed.

It is a further object of the present invention to provide a new and improved apparatus for adjusting a window cover which is of a durable and reliable construction.

An even further object of the present invention is to provide a new and improved apparatus for adjusting a window cover which is susceptible of a low cost of manufacture with regard to both materials and labor, and which accordingly is then susceptible of low prices of sale to the consuming public, thereby making such apparatus for adjusting a window cover economically available to the buying public.

Still yet another object of the present invention is to provide a new and improved apparatus for adjusting a window cover which provides in the apparatuses and methods of the prior art some of the advantages thereof, while simultaneously overcoming some of the disadvantages normally associated therewith.

Still another object of the present invention is to selectively allow light to enter through a window with a conventional window covering situated between the window and a transparent insulation film.

Lastly, it is an object of the present invention to provide a new and improved an apparatus for adjusting a window cover including a window surrounded by a frame. Further provided is a window cover adapted to have a first orientation wherein the window cover shrouds the window and a second orientation wherein the window cover does not shroud the window. The window covering has a conventional elongated control mechanism with a first end connected to the window covering and a second end for allowing a user to transfer the window covering from the first orientation to the second orientation thereof and visa-versa. Finally, a control mechanism redirecting means is included for allowing the second end of the control mechanism to be utilized distant the window while maintaining a portion of the control mechanism adjacent the first end thereof stationary.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention shown in FIG. 2.

FIG. 4 is a perspective illustration of the second embodiment of the apparatus for adjusting a window cover.

FIG. 5 is a side elevational view of the second embodiment of the present invention shown in FIG. 4.

FIG. 6 is a front elevational view of the second embodiment of the present invention.

Similar reference characters refer to similar parts throughout the several views of the drawings.

DESCRIPTION OF THE PREFERRED EMBODIMENT

Figure 1:
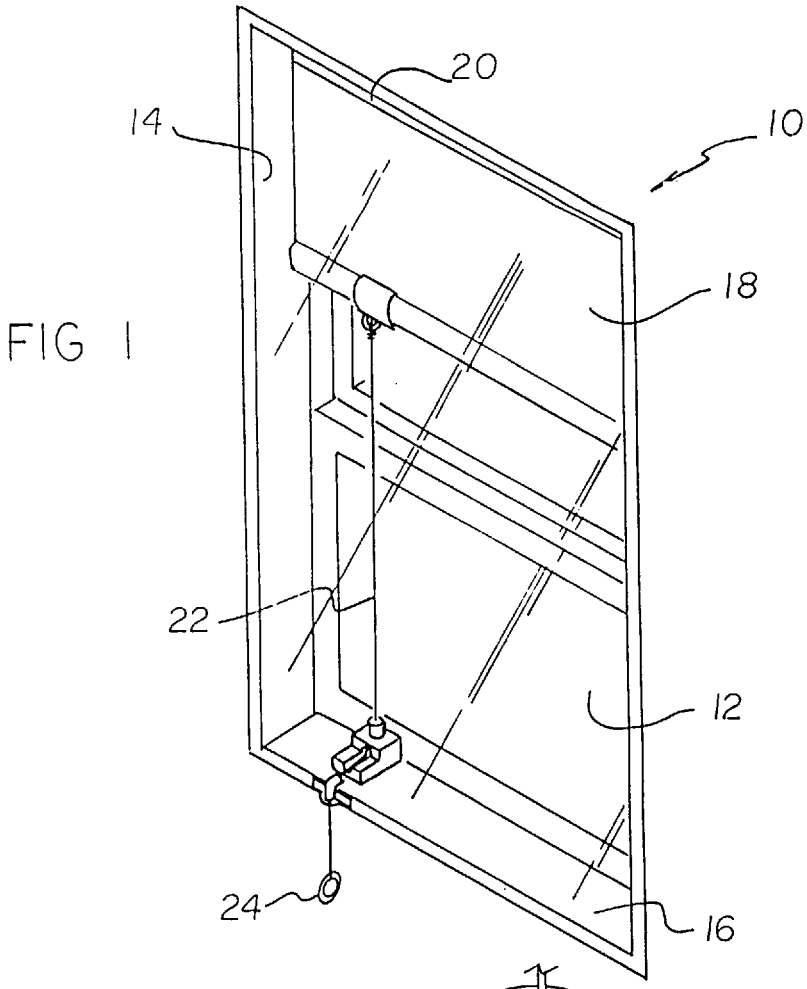
FIG. 1 is a perspective illustration of the first embodiment of the apparatus for adjusting a window cover constructed in accordance with the principles of the present invention.

With reference now to the drawings, and in particular to FIG. 1 thereof, a new and improved apparatus for adjusting a window cover embodying the principles and concepts of the present invention and generally designated by the reference numeral 10 will be described.

The present invention, the new and improved apparatus for adjusting a window cover, is comprised of a plurality of components. Such components in their broadest context include a window, a window covering, a control mechanism, and a control mechanism redirecting means. Such components are individually configured and correlated with respect to each other so as to attain the desired objective.

More specifically, it will be noted that the system 10 of the present invention includes a window 12 surrounded by a frame 14. As shown in FIG. 1, a planar horizontally oriented window sill 16 is situated coextensive with a bottom edge of the frame.

With reference to FIG. 1, a window covering in the form of a retractable window shade 18 is included with a rectangular configuration constructed from a vinyl material. Positioned coextensive with a top edge of the window is a window shade a cylindrical retracting mechanism 20 adapted to have an extended orientation wherein the window shade covers the window and a retracted orientation wherein the window shade does not cover the window. The window shade further comprises a control mechanism taking the form of an elongated pull chord 22 coupled thereto at a first end thereof. A loop 24 is connected at a second end of the pull chord for allowing a user to transfer the window shade from the extended orientation to the retracted orientation thereof and visa-versa.

Figure 2:
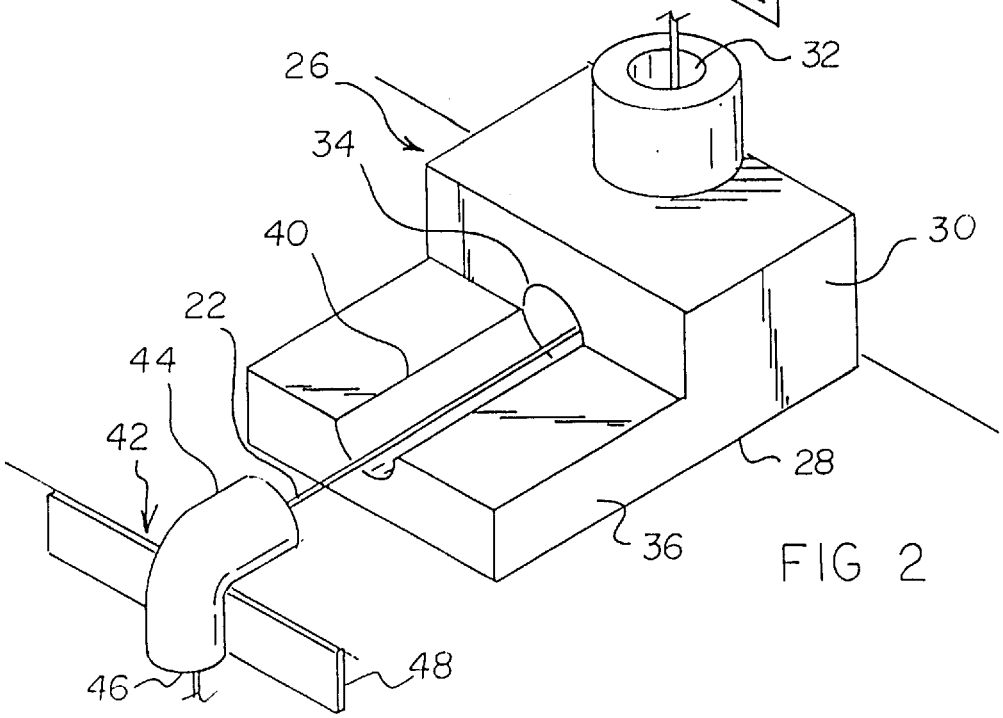
FIG. 2 is a close-up perspective view of the first embodiment of the present invention.

Further provided is a first pull chord redirecting mechanism 26 with a generally rectilinear configuration. See FIGS. 1–3. The first pull chord redirecting mechanism includes a block 28 with an inboard square portion 30 having a top face with a bore 32 formed therein and perpendicular thereto. The inboard square portion of the block further includes a bottom face and an outboard face with a bore 34 formed therein and perpendicular thereto such that the bore is in communication with the bore of the top face. The inboard square block further includes an inboard face which abuts the frame of the window. Also, as shown in the Figures, a ring surrounds the bore of the top face.

The first pull chord redirecting mechanism further has an outboard square portion 36 with a top face, a bottom face, an outboard face, and an inboard face. The inboard face is formed integrally with the outboard face of the inboard portion, wherein the outboard square portion has a height half that of the inboard square portion. The bottom face of both the inboard square portion and the outboard square portion are adhered to the window sill with an adhesive shown in FIG. 3. The top face of the outboard square block has a semi-tubular cut out 40 formed in axial alignment with the bore of the outboard face of the outboard square block.

Working in conjunction with the first pull chord redirecting mechanism is a second pull chord redirecting mechanism 42. The second pull chord redirecting mechanism has a tubular L-shaped configuration with a first horizontally oriented extent 44 situated on an outer edge of the window sill in axial alignment with the bore of the outboard face of the inboard square block. The second pull chord redirecting mechanism further includes a second vertically oriented extent 46 in communication with the first extent. Such vertically oriented extent is situated coextensive with a vertical axis orthonormal to the first extent of the second pull chord redirecting mechanism. The second vertically oriented extent also has a plate 48 integrally attached thereto for adhering to the periphery of the window sill. By this structure, the second pull chord redirecting mechanism is maintained in its intended position with respect to the first pull chord redirecting mechanism and the pull chord is directed through the bores such that the loop may be manipulated by a user distant the window.

In an alternate embodiment shown in FIGS. 4–6, the window and frame are equipped with a window covering taking the form of a plurality of horizontally orientated blinds 50. The blinds have a first orientation wherein the blinds cover the window and a second orientation wherein the window shade do not cover the window.

In lieu of using a pull chord as a control mechanism, an alternate mechanism is utilized in the present embodiment with an inboard extent 52 and outboard extent 54. The inboard extent 52 includes a wire situated within a flexible encasing having a first end coupled to the blinds and a second end. The outboard extent 54 comprises an elongated rigid rod coupled to the second end of the wire, whereby the window blinds are transferred from the first orientation to the second orientation thereof and visa-versa via rotation of the rigid rod and wire, as is conventional in the art.

As shown in FIG. 6, the redirecting mechanism of the present embodiment includes a rectangular plate 56 adhered at a point adjacent but separate to the frame. An inverted L-shaped hollow tube 58 is integrally formed to the plate. The hollow tube has a top horizontal portion 60 with a first end positioned proximal to the window and a second end positioned distant from the window. Associated therewith is a bottom vertical portion 62 with a first end formed integrally and in communication with the second end of the horizontal portion. In operation, the wire is situated within the hollow tube with the second end thereof situated coextensive with a second open end of the vertical portion whereat the rigid rod depends vertically distant the window for manipulation.

In use, the present embodiment allows the control mechanism to be positioned distant from the window thus allowing operation of the associated window covering with an additional transparent insulation film 64 which covers the frame, wherein the window covering is situated between the window and the transparent insulation film. Since a portion of the control mechanism situated adjacent the window is stationary, it may be conveniently slipped through the transparent film without disturbing the same. It should be noted that the control mechanism may further be elongated thus allowing control of the window covering from afar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for adjusting a window cover comprising, in combination:

a window surrounded by a frame and having a planar horizontally oriented window sill situated coextensive with a bottom edge thereof;

a retractable window shade with a rectangular configuration constructed from a vinyl material, the window shade further comprising a cylindrical retracting mechanism coupled coextensive with a top edge of the window and adapted to have an extended orientation wherein the window shade covers the window and a retracted orientation wherein the window shade does not cover the window, the window shade further comprising an elongated pull chord coupled thereto at a first end thereof and with a loop connected at a second end thereof for allowing a user to transfer the window shade from the extended orientation to the retracted orientation thereof and visa-versa;

a first pull chord redirecting mechanism with a rectilinear configuration including a block including an inboard square portion having a top face with a bore formed therein and perpendicular thereto, a bottom face, and an outboard face with a bore formed therein and perpendicular thereto such that the bore is in communication with the bore of the top face, the inboard square block further including an inboard face, the inboard face abutting the frame of the window; the first pull chord redirecting mechanism further having an outboard square portion with a top face, a bottom face, an outboard face, and an inboard face formed integrally with the outboard face of the inboard portion, wherein the outboard square portion has a height half that of the inboard square portion and the bottom face of both the inboard square portion and the outboard square portion are adhered to the window sill, the top face of the outboard square block having a semi-tubular cut out formed in axial alignment with the bore of the outboard face of the outboard square block; and a second pull chord redirecting mechanism having a tubular L-shaped configuration with a first horizontally oriented extent situated on an outer edge of the window sill in axial alignment with the bore of the outboard face of the inboard square block, the second pull chord redirecting mechanism further including a second vertically oriented extent in communication with the first extent and situated coextensive with a vertical axis orthonormal to the first extent of the second pull chord redirecting mechanism, the second extent having a plate integrally attached thereto for adhering to the window sill thereby maintaining the second pull chord redirecting mechanism in its intended position;

whereby the loop of the pull chord extends away from the window sill allowing an additional transparent insulation means which covers the frame to be utilized in conjunction with maintaining operation of the window shade, wherein the window shade is situated between the window sill and the transparent insulation means.

2. An apparatus for adjusting a window cover comprising:

a window surrounded by a frame;

a window covering means adapted to have a first orientation wherein the window covering means covers the window and a second orientation wherein the window covering means does not cover the window, the window covering having a conventional elongated control means with a first end connected to the window covering and a second end for allowing a user to transfer the window covering from the first orientation to the second orientation thereof and visa-versa; and control means redirecting mechanism for allowing the second end of the control means to be utilized distant the window while maintaining a portion of the control means adjacent the first end thereof stationary;

said window having a horizontally oriented window sill situated coextensive with a bottom edge thereof;

said window covering means constructed from a vinyl material and comprises a cylindrical retracting mechanism coupled coextensive with a top edge of the window and the control means comprises an elongated pull chord with a loop connected on the second end thereof, whereby the window covering means is transferred from an extended orientation to a retracted orientation and visa-versa via pulling the pull chord;

said control means redirecting mechanism including a first pull chord redirecting mechanism including a block including an inboard portion having a top face with a bore formed therein and perpendicular thereto, a bottom face, and an outboard face with a bore formed therein and perpendicular thereto such that the bore is in communication with the bore of the top face, the inboard square block further including an inboard face, the inboard face abutting the frame of the window; the first pull chord redirecting mechanism further having an outboard portion with a top face, a bottom face, an outboard face, and an inboard face formed integrally with the outboard face of the inboard portion, wherein both the inboard square portion and the outboard square portion are adhered to the window sill, the top face of the outboard square block having a semi-tubular cut out formed in axial alignment with the bore of the outboard face of the outboard square block.

3. An apparatus for adjusting a window cover as set forth in claim 2 wherein the control means redirecting mechanism further includes a second pull chord redirecting mechanism having a tubular L-shaped configuration with a first horizontally oriented extent situated on an outer edge of the window sill in axial alignment with the bore of the outboard face of the inboard square block, the second pull chord redirecting mechanism further including a second vertically oriented extent in communication with the first extent and situated coextensive with a vertical axis orthonormal to the first extent of the second pull chord redirecting mechanism, the second extent having a plate integrally attached thereto for adhering to the window sill thereby maintaining the second pull chord redirecting mechanism and its intended position.

4. An apparatus for adjusting a window cover comprising:

a window surrounded by a frame;

a window covering means adapted to have a first orientation wherein the window covering means covers the window and a second orientation wherein the window covering means does not cover the window, the window covering having a conventional elongated control means with a first end connected to the window covering and a second end for allowing a user to transfer the window covering from the first orientation to the second orientation thereof and visa-versa; and control means redirecting mechanism for allowing the second end of the control means to be utilized distant the window while maintaining a portion of the control means adjacent the first end thereof stationary;

said the window covering means constructed from a plurality of horizontally orientated blinds and the control means comprises an inboard extent including a wire situated within a flexible encasing, the inboard extent having a first end coupled to the blinds and a second end, the control means further comprising an outboard extent comprising an elongated rigid rod coupled to the second end of the wire, whereby the window covering means is transferred from the first orientation to the second orientation thereof and visa-versa via rotation of the rigid rod and wire;

said control means redirecting mechanism including a plate adhered at a point adjacent but separate to the frame and an inverted L-shaped hollow tube integrally formed to the plate, the hollow tube having a top horizontal portion with a first end positioned proximal to the window and a second end positioned distant from the window and with the tube further having a bottom vertical portion with a first end formed integrally and in communication with the second end of the horizontal portion and a second open end, whereby the wire is situated within the hollow tube with the second end thereof situated coextensive with the second open end of the vertical portion whereat the rigid rod depends vertically distant the window for manipulation.

* * * * *